US008474886B2

(12) United States Patent
Bendel

(10) Patent No.: US 8,474,886 B2
(45) Date of Patent: Jul. 2, 2013

(54) VEHICLE DOOR LATCH

(75) Inventor: Thorsten Bendel, Oberhausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 312 days.

(21) Appl. No.: 12/788,217

(22) Filed: May 26, 2010

(65) Prior Publication Data

US 2010/0253095 A1 Oct. 7, 2010

Related U.S. Application Data

(63) Continuation-in-part of application No. 10/563,949, filed as application No. PCT/DE2004/001353 on Jun. 26, 2004, now Pat. No. 7,946,634.

(30) Foreign Application Priority Data

Jul. 9, 2003 (DE) ..... 103 31 080

(51) Int. Cl.
*E05C 3/06* (2006.01)

(52) U.S. Cl.
USPC ..... 292/200; 292/201; 292/216

(58) Field of Classification Search
CPC ..... E05B 81/06; E05B 53/003; E05B 81/14; E05B 85/26
USPC ..... 292/95, 110, 111, 201, 216, DIG. 23, 292/200
See application file for complete search history.

(56) References Cited

U.S. PATENT DOCUMENTS

| | | | | |
|---|---|---|---|---|
| 5,020,838 | A * | 6/1991 | Fukumoto | 292/201 |
| 5,078,436 | A * | 1/1992 | Kleefeldt et al. | 292/201 |
| 5,106,135 | A * | 4/1992 | Menke et al. | 292/216 |
| 5,183,300 | A * | 2/1993 | Bonne et al. | 292/216 |
| 5,419,597 | A * | 5/1995 | Brackmann et al. | 292/201 |
| 5,454,608 | A * | 10/1995 | Dzurko et al. | 292/216 |
| 5,474,338 | A * | 12/1995 | Buscher | 292/201 |
| 5,982,126 | A * | 11/1999 | Hellinga et al. | 318/468 |
| 6,007,118 | A * | 12/1999 | Arabia et al. | 292/216 |
| 6,158,788 | A * | 12/2000 | Ikeda et al. | 292/216 |
| 6,390,517 | B1 | 5/2002 | Ehret | |
| 6,419,286 | B1 * | 7/2002 | Szablewski | 292/216 |
| 2002/0063430 | A1 | 5/2002 | Amano | |
| 2002/0157435 | A1 * | 10/2002 | Wicker | 70/237 |
| 2004/0094971 | A1 * | 5/2004 | Warmke et al. | 292/201 |

FOREIGN PATENT DOCUMENTS

| | | |
|---|---|---|
| EP | 1085148 | 3/2001 |
| JP | H09-287337 | 11/1997 |
| WO | 03018939 | 3/2003 |

OTHER PUBLICATIONS

Japan Patent Office, Office Action, Japanese Patent Application No. 2006-517949, dated Feb. 2, 2010, 3 pages.

* cited by examiner

*Primary Examiner* — Kristina R Fulton
*Assistant Examiner* — Nathan Cumar
(74) *Attorney, Agent, or Firm* — Konomi Takeshita

(57) ABSTRACT

The object of the present invention is a vehicle door latch, whose basic version contains a locking mechanism (1, 2) with at least one operating lever (3) for the locking mechanism (1, 2) and a motor drive (4, 5, 6, 7) for opening the locking mechanism (1, 2). According to the invention, the motor drive (4, 5, 6, 7) directly acts upon the locking mechanism (1, 2) solely via the operating lever (3).

6 Claims, 8 Drawing Sheets

VEHICLE DOOR LATCH

CROSS REFERENCE TO RELATED APPLICATIONS

This application claims priority under 35 U.S.C. 119 based upon German Patent Application No. 103 31 080.0, filed Jul. 9, 2003. This application is also a continuation-in-part application under 35 U.S.C. 120, based on U.S. application Ser. No. 10/563,949, filed on May 11, 2006. The entire disclosure of the aforesaid applications are incorporated herein by reference.

BACKGROUND OF THE INVENTION

The invention refers to a vehicle door latch with a locking mechanism, at least one operating lever for the locking mechanism and a motor drive for opening the locking mechanism. As usual, the locking mechanism mainly consists of a catch and a pawl.

Such vehicle door latches are adequately known and are used where such a latch is to be opened electrically. As such a motor drive generally contains an electric motor. The described electric opening is, for instance but not exclusively, initiated by a so-called "keyless entry" or "keyless go" operation. In this case, an upstream wireless authorization check is carried out on an operator seeking to gain access, which after a positive check actuates the motor drive for opening the locking mechanism, so that immediately afterwards, a vehicle door can be opened and/or released. This may also be motor-driven or manual process.

At the same time, it is also possible to operate an internal door handle or external door handle, with this action being detectable by a switch assigned to the respective handle. Depending on the functional position of the vehicle door latch (e.g. unlocked, locked or double locked), the obtained switching signal is converted into a respective execution signal for the motor drive.

Generally, the motor drive in question only arranges the opening of the respective locking mechanism. This means that, the mechanism must first be moved to the unlocked state if it is not already in this state. Generally, the motor drive can also be used for first unlocking the vehicle door latch and then opening the locking mechanism.

Prior art has already disclosed successful attempts of developing a vehicle door latch in such a way that its opening is guaranteed in any event. The generic WO 03/018939 A1 suggests, for instance that the motor drive acts indirectly on the operating lever or actuating lever via an intermediate energy-saving device.

A solution according to also a generic EP 1 091 061 A2 contains an already more complex mechanical system. In this system, the drive disc of the motor drive contains a driving pin, arranged with a stop on a blocking lever, arranged separately from the pawl of the locking mechanism. This blocking lever is moved along by the pawl, during its displacement, into a position releasing the catch, its blocking position. This is mechanically more complex and more expensive.

A similar system is shown in the generic door latch of EP 1 085 148 A2. In this case, too, a blocking lever is provided in addition to the opening lever with both being arranged to rotate around a common axis.—The invention aims to provide a solution for this problem.

SUMMARY OF THE INVENTION

The invention aims to solve the technical problem of providing a functional, simple and cost-effective solution for a generic vehicle door latch for motorized opening.

In order to solve this technical problem, a generic vehicle door latch according to the invention is characterized in that the motor drive directly actuates the locking mechanism and, in particular, the pawl via solely the operating lever. The motor drive may be a reversing drive and preferably contains a drive disk with front-sided cams and a rear-sided element limiting the rotation angle.

In contrast to the prior art of the two European patents EP 1 091 061 A2 and EP 1 085 148 A2 the invention expressly does not require additional levers, springs, etc. Instead it has been found to suffice for a reliable operation, if the motor drive only operates the operating lever, which in turn actuates the locking mechanism and in this case preferably the pawl. As the suggested solution uses a minimum of required components, manufacturing costs can be kept particularly low, without any danger of malfunctioning.

Generally, the element limiting the angle of rotation cooperates with a stationary stop. This stationary stop may be fixed to the frame box, latch housing, etc. Together with the element limiting the angle of rotation, the stop ensures that the rotation movements of the motor drives and thus of the drive disk, are limited in the actuation and reverse direction. The stop actually provides two stop surfaces, on one hand, for the element limiting the angle of rotation moving in the actuating direction and, on the other hand, for the element limiting the angle of rotation, moving in the reverse direction.

In most cases, the operating lever contains two arms with an operating and an actuating arm. In most cases, the operating arm is acted upon by the drive, whilst the actuating arm acts on the locking mechanism and, in this case in particular, the pawl. In addition, the operating lever may also contain a third arm, the opening arm, on which a mechanical opening device can act upon. This third arm of the operating lever thus ensures that if, for instance, the motor drive has failed, the locking mechanism can still be mechanically opened. A closing cylinder with a cam could, for instance, act upon this third arm.

From a procedural point of view, the motor drive generally acts upon the drive disk in actuation direction for opening the locking mechanism until the element limiting the angle of rotation, lies against the stop in an opening position. As already described, the stop contains two stop surfaces, an actuating and a reversing surface. In the opening position, the element limiting the angle of rotation, lies against the actuating surface of the stop.

The opening position is then maintained, until the locking mechanism has been reliably opened. It is, for instance, possible to detect this locking mechanism opening using a sensor on e.g. the catch—a catch switch or similar. Once the fully opened catch actuates the respective catch switch, the control unit detects that the locking mechanism is open and that the opening position can be released (again). Whilst the motor drive acts upon the drive disk and/or the operating lever in its actuating direction for opening the locking mechanism and also in the opening position, the operating lever generally ensures that the pawl pivots and is lifted off the catch so that the catch can be opened with the aid of a spring. Only once the locking mechanism has been reliably opened, does the control unit send out the reversing command to the motor drive.

After opening the locking mechanism, the motor drive acts upon the operating lever in its reverse direction until the pawl, previously held by the operating lever, is released. As the catch is open in this situation, the released pawl lies against the catch and can, during the subsequent (manual) closing operation of the vehicle door easily engage with the catch, if the latter is moved into the locking position by a locking bolt during this process.

The opening position of the operating lever, described above and thus also the drive disk, can be set and maintained without requiring considerable force from the motor drive. This is due to the fact that the operating lever contains a spring against which the motor drive has to act when opening the locking mechanism. According to the invention, this counterforce generated by the spring, is applied radially in direction onto a rotational axis of the drive disc and, preferably, through the cam, thereby generating a frictional force on a generally flat surface of the cam, causing the cam to temporarily engage the operating lever.

Because of this design, the motor drive could, strictly speaking, even be switched off in the opening position and its self-locking forces would suffice, as the counterforce of the spring only acts radially in direction of the axis of rotation of the drive disk onto the cam and no lateral forces are applied. As there are no lateral forces, the cam is neither turned in one nor the other direction by the spring on the operating lever in the opening position. Rotations in actuating direction are blocked anyway, as the element limiting the angle of rotation lies against the actuating surface of the stop.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIGS. 1 to 4 show the vehicle door latch of the invention in various functional positions, from the front and rear and, in which

DETAILED DESCRIPTION OF THE INVENTION

Figure 1:
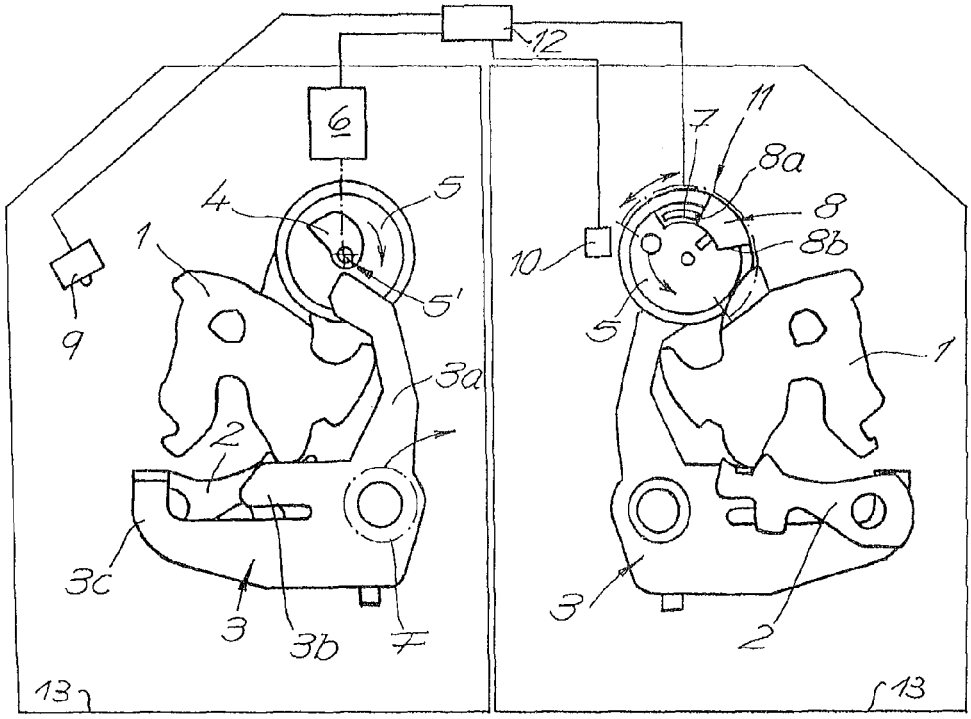
Figure 2:
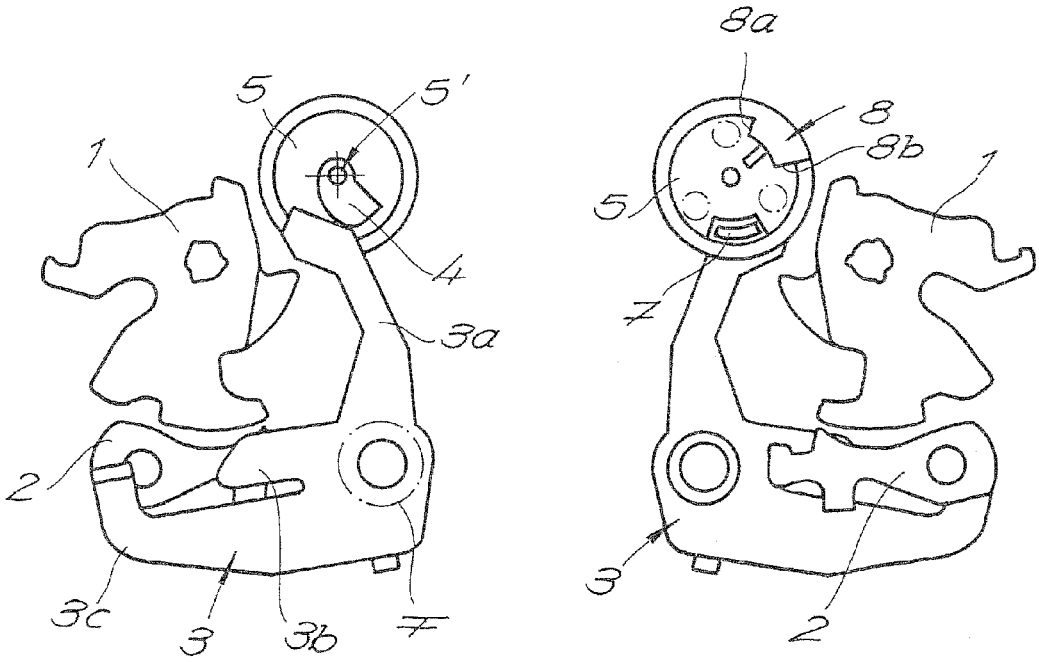

In the following, preferred modes of the present invention will be described in detail with reference to the accompanying, exemplary diagrams. FIGS. 1 to 5 relate to one aspect of the present invention.

The figures show a vehicle door latch containing, as usual, a locking mechanism 1, 2 comprising a catch 1 and pawl 2. The figures also show an operating lever 3 for the locking mechanism 1, 2 and a motor drive 4, 5, 6, 7 for opening the locking mechanism 1, 2. The motor drive 4, 5, 6, 7 actually comprises an electric motor 6, a drive disk 5, a cam or actuating cam 4 arranged on the drive disk 5 and an element limiting the angle of rotation 7. The cam, as commonly known in the art, may have an irregular-shaped wheel with an end portion located about a cam rotational axis coincident with a rotational axis of the drive disk 5, as shown in the figures. The electric motor 6 is able to move the drive disk 5 in clockwise and counterclockwise direction and thus operates—like the entire motor drive 4, 5, 6, 7—reversibly. That is, the electric motor 6 is capable of turning in both an actuation direction and in a reverse direction for directly driving the rotations of the drive disk 5 in both an actuation direction and in a reverse direction. This is indicated by the double arrow in FIG. 1.

It is apparent that the motor drive 4, 5, 6, 7 directly acts upon the locking mechanism 1, 2 via solely the operating lever 3. For this purpose, the operating lever 3 contains a total of three arms, an operating arm 3*a*, an actuating arm 3*b* and an opening arm 3*c*. The opening arm 3*c* ensures that the locking mechanism 1, 2 can also be opened if the motor drive 4, 5, 6, 7 has failed, e.g. mechanically via a closing cylinder or a similar not expressly shown opening device. This is, however, not mandatory and opening arm 3*c* is simply an option for the invention.

Significant for the motorized opening as part of the invention is, however, the operating arm 3*a*, acted upon by drive 4, 5, 6, 7 or, more accurately, by cam 4. As shown in the figures, the cam may be a front-sided cam for causing a reciprocating motion of the operating lever 3 by acting upon its operating arm 3*a*. Also the actuation arm 3*b*, acting upon the locking mechanism 1, 2 or, more accurately, pawl 2.

The rear views show that the drive disk 5 contains the element limiting the angle of rotation 7 on its back. This element limiting the angle of rotation 7 co-operates with a stationary stop 8 that can be fixed to latch housing 13. The stationary stop 8 contains two stop surfaces 8*a*, 8*b*, an actuating surface 8*b* and a reversing surface 8*a*.

Also, two further functional elements are provided, in form of a spring F—only indicated—acting upon the operating lever 3 in the direction shown in FIG. 1. This means that the operating lever 3 is acted upon by spring F in clockwise direction around its axis in the respective front view. In addition, there are individual sensors 9, 10, 11, to signal, on one hand, the position of catch 1 and, on the other hand, the position of the drive disk 5 and of the motor drive 4, 5, 6, 7 to a control unit 12. Depending on the functional position of the vehicle door latch, the control unit 12 passes on respective commands to the electric motor 6 for its actuation.

The system functions as follows. Starting from a position as shown in FIG. 1 with a closed locking mechanism 1, 2, i.e. with pawl 2 engaged in the primary position of catch 1, the motor drive 4, 5, 6, 7 is acted upon in such a way for opening the locking mechanism 1, 2 that the drive disk 5 in the front view of FIG. 1 carries out the indicated clockwise movement around its axis 5'. This corresponds to a counterclockwise movement in the rear view in the right part of FIG. 1.

Figure 5:
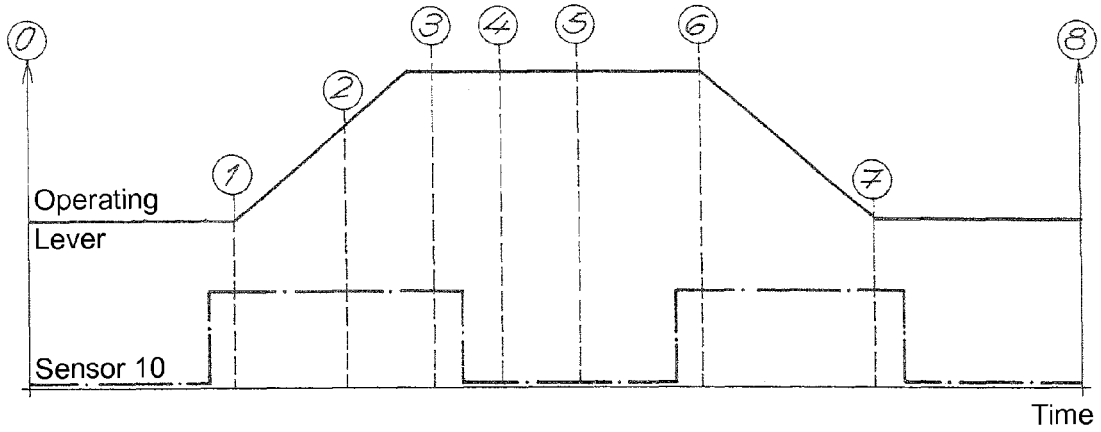
FIG. 5 shows a schematic functional flow diagram over time.

After a certain displacement travel, a sensor surface 11 reaches the sensor or switch 10, so that it transmits a first signal to the control unit 12, as indicated by the rising edge in the bottom part of FIG. 5. Cam 4 then makes contact with the operating arm 3*a* of the operating lever 3.

The motor drive 4, 5, 6, 7 acts upon the operating lever 3 in its activation or actuation direction for opening the locking mechanisms 1, 2 (clockwise movement of drive disk 5 in front view in FIG. 1) until the element limiting the angle of rotation 7 lies against the stop 8 or, more accurately, against its actuating surface 8*b*. This status becomes clear in the transition from FIG. 1 to FIG. 2 and on to FIG. 3. Before, however, this so-called opening position acc. to FIG. 3 has been reached, the sensor surface 11 has ensured that the sensor or the switch 10 has received a switch-off impulse according to a second signal. At the same time, the falling edge of the first square-wave pulse in the bottom diagram of FIG. 5 has been reached.

Figure 3:
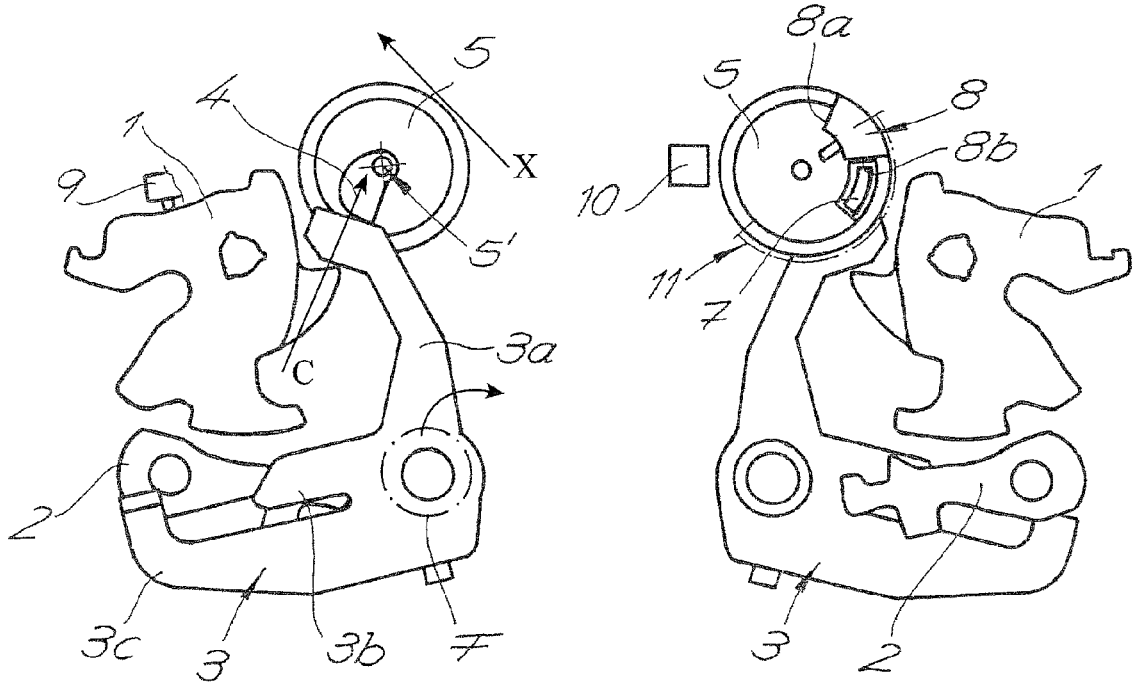

The opening position according to FIG. 3 now corresponds in such a way that the pawl 2 has been fully lifted off the catch 1, allowing the catch 1 to turn to its open position with the aid of a spring. The opening position acc. to FIG. 3 is maintained until the catch 1 has reliably reached its opening position. This consequently also applies for the entire locking mechanism 1, 2. This status is detected by the sensor or the micro switch 9, which is a catch switch.

Due to the reliable opening of the locking mechanism 1, 2 the control unit 12 now ensures that the motor drive 4, 5, 6, 7 is acted upon in reverse direction. When comparing FIGS. 3 and 4, the reverse direction corresponds so that the cam 4 and the drive disk 5 on which it is arranged, carry out a counterclockwise movement when seen from the front view, as caused by the operation of the electric motor 6 in a reverse direction. As a result, the cam 4 moves away from the operating arm 3*a* of the operating lever 3. The motor drive 4, 5, 6, 7 is thus acted upon in reversing direction until the pawl 2, previously held by the operating lever 3, is released.

Figure 4:
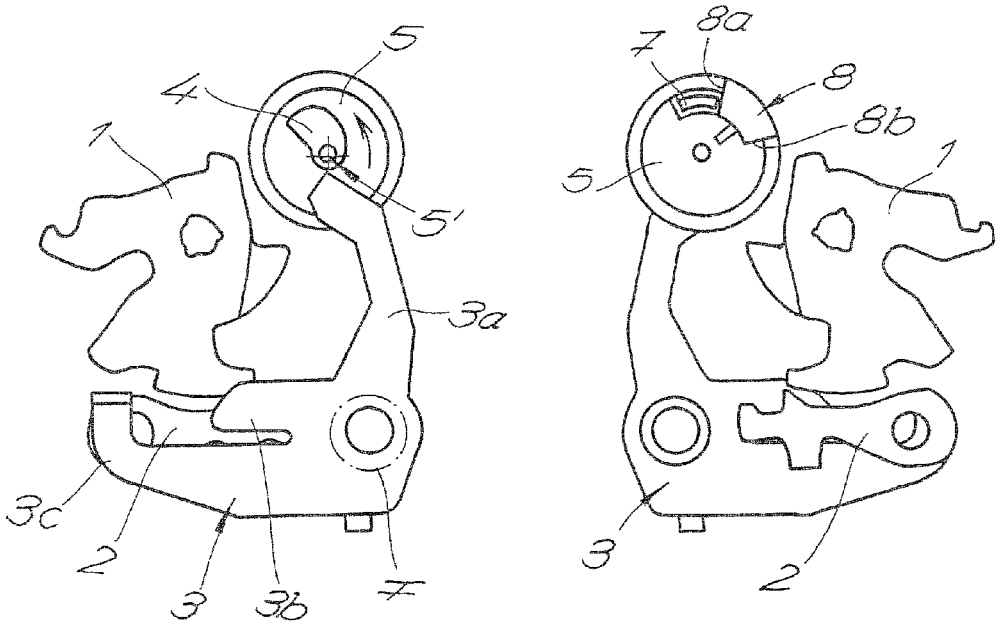

At the start of the reversing process, the sensor or the switch 10 register a switch-on process again, caused by the sensor surface 11, gliding past it. This process corresponds with the rising edge of the second square-wave pulse in the bottom diagram of FIG. 5. Upon release of the pawl 2, the element limiting the angle of rotation 7 reaches the reversing surface 8*a* of the stop 8, as shown in FIG. 4. Prior to this, the sensor area 11 generated a switch-off pulse at switch 10, corresponding with the falling edge of the second square-wave pulse.

It is apparent that, during the described process, the operating lever 3 carries out the movement shown in the top diagram of FIG. 5, with individual selected points and positions being specified. It is also significant that in the opening position in FIG. 3, the counterforce generated by spring F on the operating lever 3, runs radially in the direction of axis 5' of the drive disk 5. This is indicated by an arrow C in the respective FIG. 3. The counterforce also runs through cam 4. The curved arrow at spring F shows the direction in which the spring operates on the operating lever 3, to produce this counterforce. In this way, the opening position as shown in FIG. 3 can be reached with a minimum of force, as there are no lateral forces X that could turn the drive disk 5 in one or another direction, that is, in either the actuation or reverse directions.

As already described, the top part of FIG. 5 shows the movement of the operating lever 3, whilst the bottom part shows the signals on the sensor 10. Individually exposed time points, labeled 1 to 7, are explained below.

From the start to time point 1, the electric motor 6 starts or accelerates until there is contact between the cam 4 and the operating lever 3 at time point 1. This is followed by an operating stroke up to time point 2, when catch 1 has mainly been released. The operating lever 3 is moved on—by a certain safety angle—until position 3 has been reached. The operating lever 3 is held in this position.

At time point 4, sensor 10 first of all detects the falling edge with the passing sensor surface 11, and the micro switch or catch switch 9 have registered that the catch 1 is open. The electric motor 6 now continues to run until the drive disk 5 with its element limiting the angle of rotation 7 rests against the actuating surface 8*b* of stop 8. This occurs at time point 5.

The blocking position of the electric motors 6 can be evaluated and serves as a signal for operating the electric motor 6 in reverse. This occurs starting at time point 5 to time point 6, with the electric motor 6 accelerating in reverse direction in this time period. Once the end of the sensor surface 11 has passed the sensor or switch 10 and thus the second rising edge has been registered by sensor 10, the release of the pawl 2 commences at time point 6. This release of the pawl 2 continues up to time point 7. Once the falling edge has been registered by the sensor 10, the electric motor 6 continues to run unchanged until the element limiting the angle of rotation 7 reaches the reversing surface 8*a* of the stop 8 in position 8. In this case, too, the blocking process can be evaluated in order to reverse the direction of movement of the electric motor 6 (again).

Figure 6:
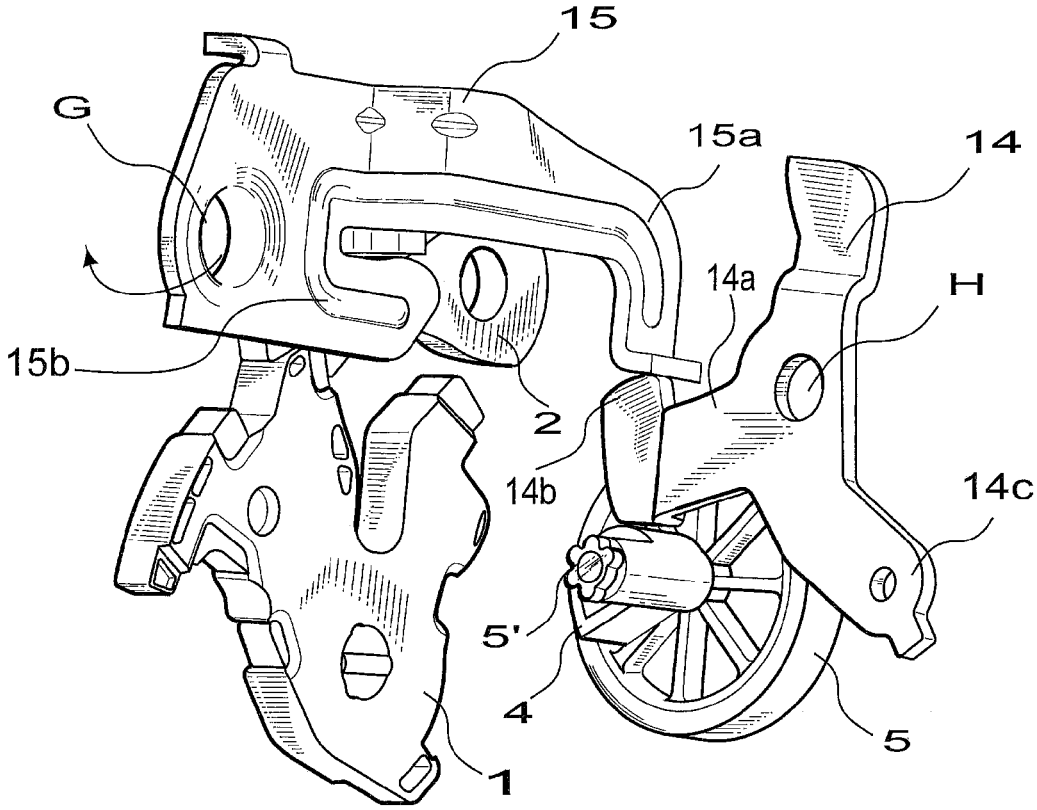
FIG. 6 shows a front and left perspective view of a second mode of the vehicle door latch of the invention at a starting position, having a closed locking mechanism.
Figure 7:
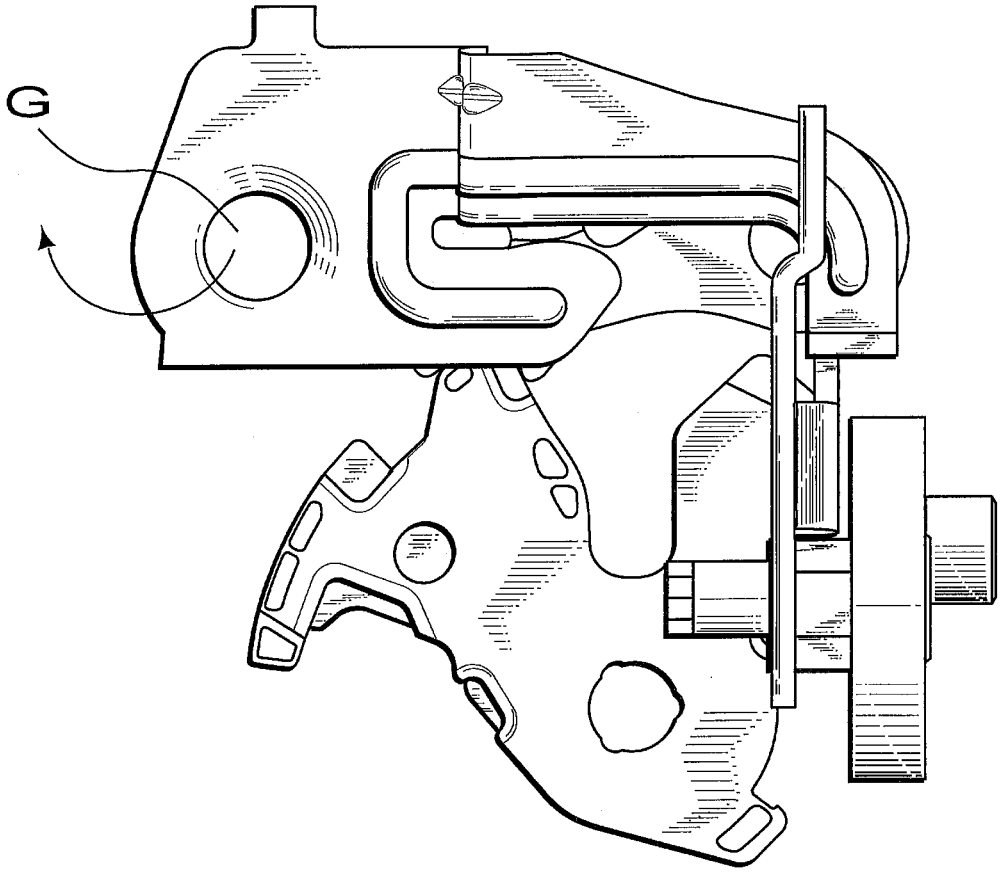
FIGS. 7 and 8 show front orthogonal and left orthogonal views, respectively, of the second mode in the starting position shown in FIG. 6.
Figure 8:
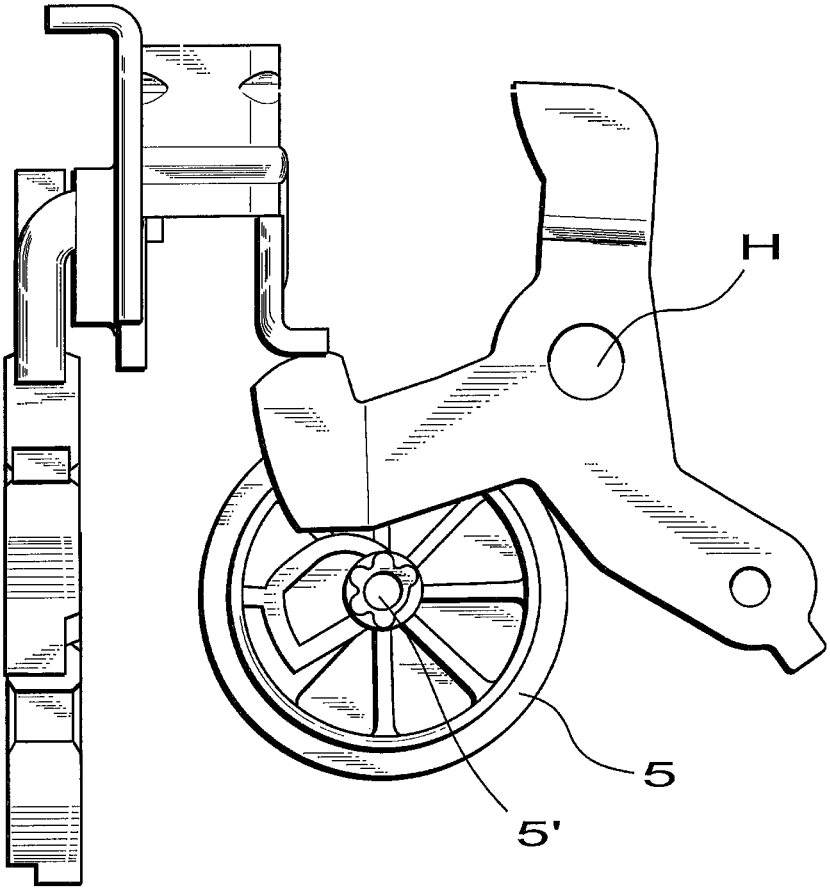

FIGS. 6 through 8 show a second aspect of the vehicle door lock of the present invention, having more than one operating lever. Specifically, this mode of the invention uses two operating levers in place of the single operating lever 3 described above. A first operating lever 14 has an operating arm 14*a* acted upon by the cam 4 of the motor drive. This first operating lever 14 then acts upon a second operating lever 15, having an actuating arm 15*b*, for acting upon the pawl 2 of the locking mechanism 1, 2. The first operating lever 14 may also have an opening arm 14*c* for ensuring that the locking mechanism 1, 2 can also be opened if the motor drive has failed, through mechanical means or other means as mentioned above.

This system consisting of two, compound operating levers 14, 15 functions essentially in the same manner the as the mode detailed above using one operating lever. That is, FIGS. 6 to 8 show a starting position with the locking mechanism 1, 2 in a closed position and the pawl 2 engaged in the primary position holding the catch 1. The drive disk 5 again is driven to move in a clockwise or actuation direction around its axis 5' through the operation or turning of the electric motor 6, such that cam 4 contacts and acts upon the operating arm 14*a* of the first operating lever 14. An opposite side of the operating arm 14*a* then acts upon an operating arm 15*a* of the second operating lever 15. The force applied to the operating arm 15*a* by the first operating arm 14*a* causes the actuating arm 15*b* of the second operating lever 15 to pivot the pawl and lift the pawl 2 fully off of the catch 1, which then turns to its open position with the aid of a spring (not shown).

Meanwhile, the drive disk 5 had continued its clockwise movement until the element limiting the angle of rotation 7 lies against the stop 8 (not shown in FIGS. 6 to 8) as described above and switch 10 has received a switch-off impulse. Upon the reaching of an opening position wherein the pawl 2 is fully lifted off the catch as described above, such position is maintained until the catch 1 has reliably reached its opening position through the aid of the spring, as detected by the catch switch 9 (not shown in FIGS. 6 to 8).

Due to that reliable opening of the locking mechanism, the control unit 12 now ensures that the motor drive 4, 5, 6, 7 is acted upon in a reverse direction, as described above. That is, the electric motor 6 now operates or turns in a reverse direction to directly drive the drive disk 5 and the cam 4 to turn in a reverse direction. The cam 4 and the drive disk 5 thus carry out a counterclockwise movement when seen from the front. The cam 4 moves away from the operating arm 14*a* of the first operating lever 14, and the motor drive 4, 5, 6, 7 operates in the reverse direction until the pawl 2 that was held by the second operating lever 15 is released.

Again, at the opening position, it is apparent that the counterforce generated by spring G on the second operating lever 15 and spring H on the first operating lever would run radially in the direction of axis 5' of the drive disk 5, as described above for the previous mode. The counterforce would also run through cam 4. In this way, the opening position (as previously illustrated in FIG. 3) can be reached with a minimum of force, as there are no lateral forces that could turn the drive disk 5 in either the actuation or the reverse direction. The counterforce naturally causes the generation of a frictional force on a generally flat surface of the cam 4, causing the cam 4 to temporarily engage the operating arm 14*a* of the first operating lever 4, in order to set and maintain the opening position of the drive disk 5, until the catch 1 has reliably reached its opening position through the aid of a spring as described above.

As in the previously described mode, it is again apparent that the motor drive 4, 5, 6, 7 arrangement acts upon the locking mechanism 1, 2, directly and solely through the contact of the cam 4 with the first operating lever 14, which then contacts the second operating lever 15 for acting upon the locking mechanism 1, 2.

In all other respects, this second mode of the invention functions essentially in the same manner as described above for the first mode, with the compound lever system of the first operating lever 14 and the second operating lever 15 carrying out the movement previously accomplished by a single operating lever 3, as shown in the top diagram of FIG. 5.

The above detailed arrangement permits the present invention to be used for the reliable opening of the locking mechanism, even when there is a space or distance between parts of the vehicle door latch, such as between the motor drive and the locking mechanism. It is to be understood that other variations as would be readily apparent to one skilled in the art are intended to be within the scope of the present invention. As an example, the vehicle door latch of the present invention may further utilize three or more operating levers, essentially acting upon each other to function similarly to the manner described above. That is, the invention may use at least one operating lever, or either a single or a plurality of such operating levers that function by acting upon and engaging each other in a compound manner or otherwise. Such functioning reliably opens the locking mechanism, while still maintaining the simple and cost-effective solution of the invention. The present description and drawings only one or two operating levers, since it would be impractical and unnecessary to include all such possible arrangements having essentially similar functions and effects in the invention. However, in all such cases, an essential feature of the present invention is the reverse driving of the drive disk by the reverse operation of the motor.

It is to be understood that the above-described modes are illustrative of only a few of the many possible specific embodiments which can represent applications of the principles of the invention. Numerous and varied other arrangements can be readily devised by those skilled in the art without departing from the spirit and scope of the present invention.

What is claimed is:

1. A vehicle door latch comprising:

a locking mechanism having a catch and a pawl;

at least two operating levers;

a motor drive containing a drive disk with a front-sided cam for causing a reciprocating motion of the at least two operating levers, the cam having an irregular-shaped wheel portion and an end portion located about a cam rotational axis coincident with a drive disk rotational axis, a rear-sided element limiting the angle of rotation of the drive disk and an electric motor capable of turning in both an actuation direction and a reverse direction for directly driving a corresponding rotation of said drive disk in an actuation direction and in a reverse direction, said rotations being limited by the element limiting the angle of rotation, a control unit for controlling said turning of said electric motor, and a first sensor and a second sensor for signaling to said control unit a position of a catch and a position of the drive disk, respectively, for coordinating and timing said turning of the electric motor, said rotations of the drive disk and said resulting motions of the at least two operating levers;

wherein said control unit controls said electric motor to turn in the actuation direction, resulting in the corresponding rotation of said drive disk;

said motor drive directly acts upon the locking mechanism solely via contact of the cam with a first of the at least two operating levers resulting from said driving of said drive disk in the actuation direction;

a resulting reciprocating motion of said at least two operating levers causes a pivotal engagement by a second of the at least two operating levers with said pawl, as signaled by said second sensor;

said pawl releases the catch and said rotation in the actuation direction continues until limited by the element limiting the angle of rotation, in an opening position of the drive disk, and said opening position of the drive disk is maintained until the catch rotates to a fully open position, as signaled by said first sensor;

wherein in said opening position of the drive disk, a counterforce generated by a spring on the at least two operating levers, runs solely and radially through the irregular-shaped wheel portion of the cam in the direction of a rotation axis of the drive disk without providing a lateral force running in said actuation direction or in said reverse direction on the drive disk and said counterforce generated by the spring causes a frictional force on a generally flat surface of the cam to engage the first of the at least two operating levers to set and maintain the opening position of the drive disk regardless of any driving from said electric motor, until the catch rotates to a fully open position, as signaled by said first sensor;

said driving of said drive disk then continues in the actuation direction until stopped by a stationary stop cooperating with the element limiting the angle of rotation;

based on signaling from said second sensor and the stopping of the rotation, said control unit controls said electric motor to turn in the reverse direction;

a resulting further motion of the at least two operating levers releases said pawl, as signaled by said second sensor; and said driving of said drive disk continues in the reverse direction until stopped by the stationery stop cooperating with the element limiting the angle of rotation and said at least two operating levers are held in a pawl released position.

2. The vehicle door latch according to claim 1, wherein the element limiting the angle of rotation cooperates with a stationary stop, fixed to a latch housing and limits the movements of rotation of the drive disk to the actuation and reverse directions.

3. The vehicle door latch according to claim 1, wherein the at least two operating levers contain at least two arms, an operating arm and an actuation arm.

4. The vehicle door latch according to claim 3, wherein the at least two operating levers contain three arms, including an additional opening arm.

5. The vehicle door latch according to claim 3, wherein the operating arm is acted upon by the drive, whilst the actuation arm acts upon the locking mechanism.

6. The vehicle door latch according to claim 2, wherein the motor drive acts upon the at least two operating levers in their actuating directions for opening the locking mechanism until the element limiting the angle of rotation rests against the stop in an opening position of the drive disk.

* * * * *